US005947084A

United States Patent [19]

Russell et al.

[11] Patent Number: 5,947,084

[45] Date of Patent: Sep. 7, 1999

[54] METHOD FOR CONTROLLING ENGINE IDLE SPEED

[75] Inventors: John David Russell, Farmington Hills; Todd Anthony Rumpsa, Royal Oak, both of Mich.

[73] Assignee: Ford Global Technologies, Inc., Dearborn, Mich.

[21] Appl. No.: 09/034,637

[22] Filed: Mar. 4, 1998

[51] Int. Cl.[6] ..... F02M 3/00

[52] U.S. Cl. ..... 123/339.16; 123/339.23

[58] Field of Search ..... 123/339.16, 339.23, 123/339.11

[56] References Cited

U.S. PATENT DOCUMENTS

| | | | |
|---|---|---|---|
| 4,545,449 | 10/1985 | Fujiwara . | |
| 4,617,890 | 10/1986 | Kobayashi et al. | 123/339.16 |
| 4,748,951 | 6/1988 | Manaka et al. | 123/339.16 |
| 4,838,223 | 6/1989 | Tanabe et al. | 123/339.16 |
| 4,966,111 | 10/1990 | Fujimoto et al. | 123/339.16 |
| 5,097,808 | 3/1992 | Tanaka et al. . | |
| 5,228,421 | 7/1993 | Orzel . | |
| 5,593,002 | 1/1997 | Okada et al. . | |
| 5,666,917 | 9/1997 | Fraser et al. . | |
| 5,703,410 | 12/1997 | Maekawa | 123/339.16 |

FOREIGN PATENT DOCUMENTS 2 238 845 6/1991 United Kingdom .

OTHER PUBLICATIONS

Scott A. Millsap and E. Harry Law, "Handling Enhancement Due to an Automotive Variable Ratio Electric Power Steering System Using Model Reference Robust Tracking Control," 1996, pp. 101–117, Society of Automotive Engineers, Inc. (960931).

J. W. Post and E. H. Law, "Modeling, Characterization and Simulation of Automobile Power Steering Systems for the Prediction of On–Center Handling," 1996, pp. 37–46, Society of Automotive Engineers, Inc. (960178).

Kenichi Fukumura, Kyousuke Haga, Mikio Suzuki, and Katuhisa Mori, "Center–Closed Rotary Servo Valve for Power Steering," 1996, pp. 84–92, Society of Automotive Engineers, Inc. (960929).

*Primary Examiner*—John Kwon

*Attorney, Agent, or Firm*—Raymond L. Coppiellie

[57] ABSTRACT

A method for controlling the idle speed of an internal combustion engine includes an adjustment responsive to a steering wheel angle sensor or a steering wheel torque sensor. The steering wheel angle sensor and the steering wheel torque sensor predict a power steering pump torque requirement which is used to minimize engine speed fluctuations.

16 Claims, 4 Drawing Sheets

METHOD FOR CONTROLLING ENGINE IDLE SPEED

FIELD OF THE INVENTION

The present invention relates to a method for controlling an internal combustion engine. More particularly, the present invention relates to a method for controlling engine idle speed to compensate for the effects of a power steering system.

BACKGROUND OF THE INVENTION

Hydraulic power steering systems assist drivers in turning maneuvers. Typically, torque to operate the power assist steering system is supplied by an engine. Thus, the engine control system must be able to compensate for the often sudden torque requirement from the steering system. Most engine control systems reject this type of torque disturbance by using engine speed as a feedback control variable. Because there must be some engine speed error for the engine controller to take action, fluctuations in engine speed arise at idle when the driver turns the steering wheel.

To minimize these engine speed fluctuations, power steering pressure switches and power steering pressure transducers have been used to measure the power steering pump pressure. The accessory disturbance torque is typically estimated as a function of the power steering pump pressure. The engine control system then uses the estimated torque to make corrections to the engine inputs. The engine control system reads the pressure switch or transducer, makes a calculation, and takes corrective action by adjusting an engine parameter, for example engine airflow, to compensate for the calculated torque disturbance. In this way it is possible to reduce the engine speed fluctuations. Such a system is disclosed in U.S. Pat. No. 5,097,808.

The inventors herein have recognized numerous disadvantages with the above approach. One disadvantage is performance limitations caused by the use of a pressure switch or a pressure transducer. The pressure measurement can not be used in other systems in the vehicle such as, for example, ride control systems. A second disadvantage is that because the pressure switch and transducer are measuring a pressure at the exact time the torque disturbance interacts with the engine, and because it takes a finite time for the engine control system to read the pressure switch or transducer, make a calculation, and take corrective action, there will be an engine speed fluctuation. Stated another way, by the time the engine control system has used the information from the pressure switch or transducer to adjust engine control parameters, the engine speed has already been affected by the accessory disturbance torque.

SUMMARY OF THE INVENTION

An object of the invention claimed herein is to provide a method for preventing engine speed fluctuations resulting from power steering accessory torque disturbances.

The above object is achieved, and problems of prior approaches overcome, by the present invention which comprises an idle speed control adjustment method for an internal combustion engine of a vehicle provided with a power steering system accessory powered by the engine. The method comprises the steps of generating a power steering pump torque requirement estimate in response to a steering torque measurement and adjusting an engine control signal in response to the power steering pump torque requirement estimate.

The present invention further contemplates a control system for controlling engine idle speed in a vehicle including a power steering pump, a steering gear, and a steering wheel connected to the steering gear by a linkage. The system comprises a steering wheel position sensor, an engine speed sensor, a vehicle speed sensor, and a controller for creating an estimated power steering pump torque requirement in response to the steering wheel position sensor and for adjusting an engine control signal in response to the estimated power steering pump torque requirement.

An advantage of the present invention is that the engine control system can estimate the power steering accessory disturbance torque before the disturbance interacts with the engine.

Another advantage of the present invention is that the engine control system can use the more timely power steering accessory disturbance torque estimate to decrease the engine speed fluctuations.

Still another advantage of the present invention is that the estimate or measurement of the steering torque can be used by other control systems in the vehicle, such as a vehicle dynamics control system thus reducing overall system cost.

Other objects, features and advantages of the present invention will be readily appreciated by the reader of this specification.

DETAILED DESCRIPTION OF THE PREFERRED EMBODIMENTS

Figure 1:
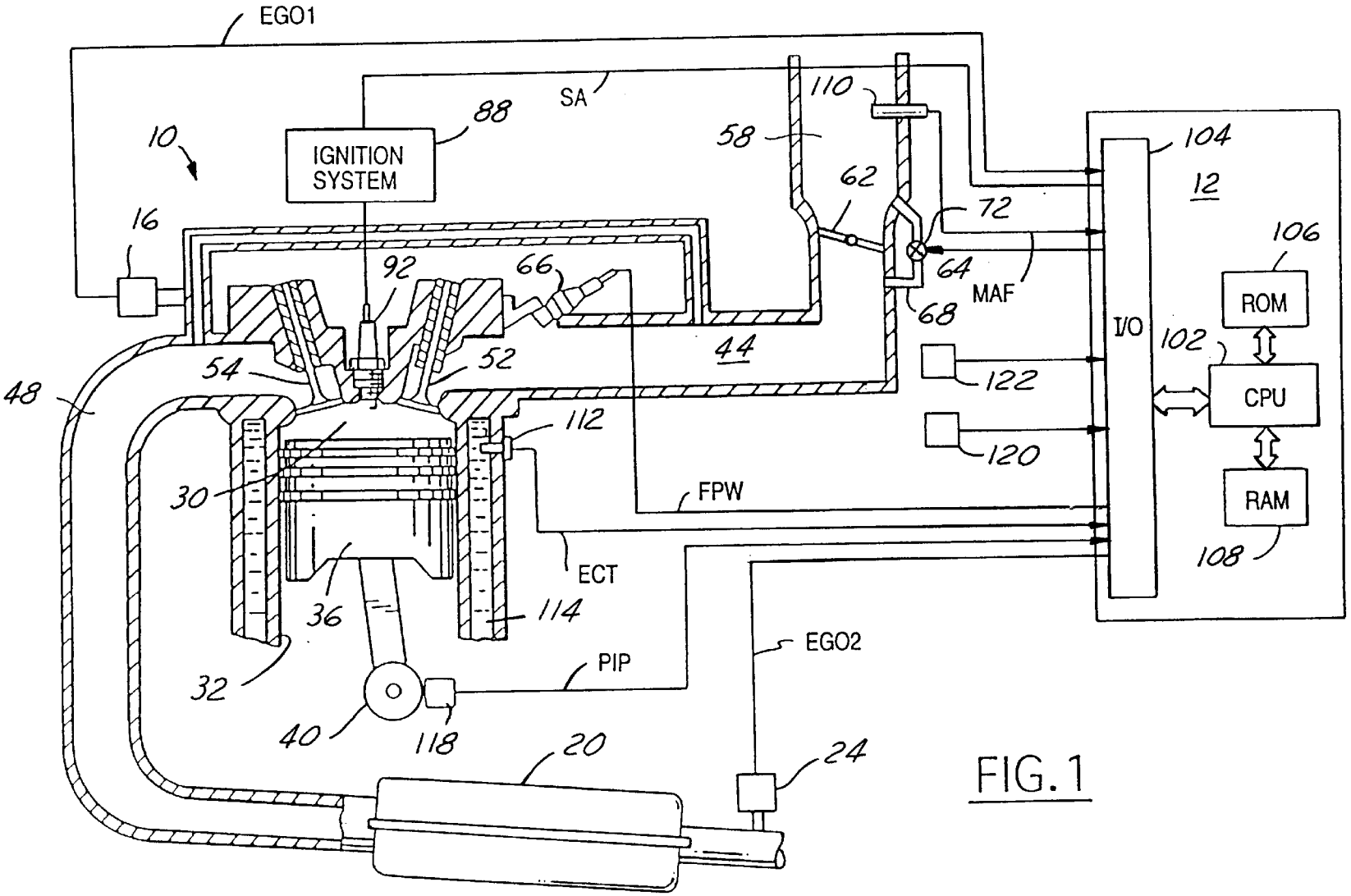
FIG. 1 is a schematic diagram of an engine in which the invention is used to advantage.

Internal combustion engine 10 comprising a plurality of cylinders, one cylinder of which is shown in FIG. 1, is controlled by electronic engine controller 12. In general terms which are described later herein, controller 12 controls operation of engine 10 by the following control signals: pulse width signal, FPW, for controlling liquid fuel delivery; spark advance signal, SA, for controlling ignition timing; and idle speed duty cycle signal, ISDC, for controlling engine idle speed.

Continuing with FIG. 1, engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. Bypass throttling device 64 is shown coupled to throttle body 58 and includes: bypass conduit 68 connected for bypassing throttle 62; and solenoid valve 72 for throttling conduit 68 in proportion to the duty cycle of idle speed duty cycle signal, ISDC, from controller 12. Intake manifold 44 is also shown having fuel injector 66 coupled thereto for delivering liquid fuel in proportion to the pulse width of signal, FPW, from controller 12. Fuel is delivered to fuel injector 66 by a conventional fuel system (not shown) including a fuel tank, fuel pump, and fuel rail (not shown).

Conventional distributorless ignition system 88 provides ignition spark to combustion chamber 30 via spark plug 92 in response to signal, SA, from controller 12. Two-state exhaust gas oxygen sensor 16 is shown coupled to exhaust manifold 48 upstream of catalytic converter 20. Two-state exhaust gas oxygen sensor 24 is shown coupled to exhaust manifold 48 downstream of catalytic converter 20. Sensor 16 provides signal, EGO1, to controller 12 which converts signal, EGO1 into two-state signal, EGOS1. A high voltage state of signal, EGOS1, indicates exhaust gases are rich compared to a reference air/fuel ratio and a low voltage state of converted signal, EGO1, indicates exhaust gases are lean compared to the reference air/fuel ratio. Sensor 24 provides signal, EGO2, to controller 12 which converts signal, EGO2 into two-state signal, EGOS2. A high voltage state of signal, EGOS2 indicates exhaust gases are rich compared to a reference air/fuel ratio and a low voltage state of converted signal, EGO1 indicates exhaust gases are lean compared to the reference air/fuel ratio.

Controller 12 is shown in FIG. 1 as a conventional microcomputer including: microprocessor unit 102, input/output ports 104, read only memory 106, random access memory 108, and a conventional data bus. Controller 12 is shown receiving various signals from sensors coupled to engine 10, in addition to those signals previously discussed, including: measurements of inducted mass air flow, MAF, from mass air flow sensor 110 coupled to throttle body 58; engine coolant temperature, ECT, from temperature sensor 112 coupled to cooling sleeve 114; a measurement of manifold pressure, MAP, conventionally used as an indication of engine load, from manifold pressure sensor 116 coupled to intake manifold 44; a measurement of steering wheel position from steering wheel angle sensor 120; a measurement of steering wheel torque from steering wheel torque sensor 122; and a profile ignition pickup signal, PIP, from Hall effect sensor 118 coupled to crankshaft 40.

Figure 2:
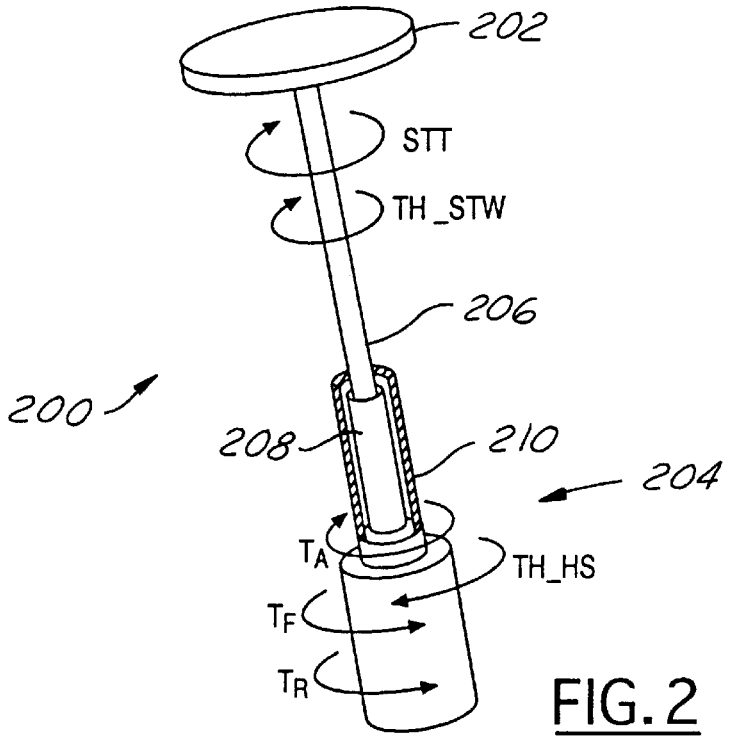
FIG. 2 is a diagram of a steering system.

Steering system 200 is now described with particular reference to FIG. 2. Steering system 200 is shown comprising steering wheel 202, steering valve 204, torsion bar 208, and steering column 206. Steering wheel position, TH_STW, and steering wheel torque, STT, applied by a vehicle operator are also indicated. Housing 210 of steering valve 204 is shown coupled to the opposite end of torsion bar 208. Housing position, TH_HS, is also shown. As steering wheel 202 is maneuvered by the vehicle operator, a difference between steering wheel position, TH_STW, and housing position, TH_HS, creates assist torque, TA, as described later herein with particular reference to FIG. 3. Friction torque, TF, is caused by the presence of friction in various locations in steering system 200, such as, for example, friction in steering valve 204. Road torque, TR, is due to interactions between steering system 200 and the suspension system (see FIG. 3). A total of assist torque, TA, steering wheel torque, STT, friction torque, TF, and road torque, TR, causes the vehicle wheels (see FIG. 3) to move.

Figure 3:
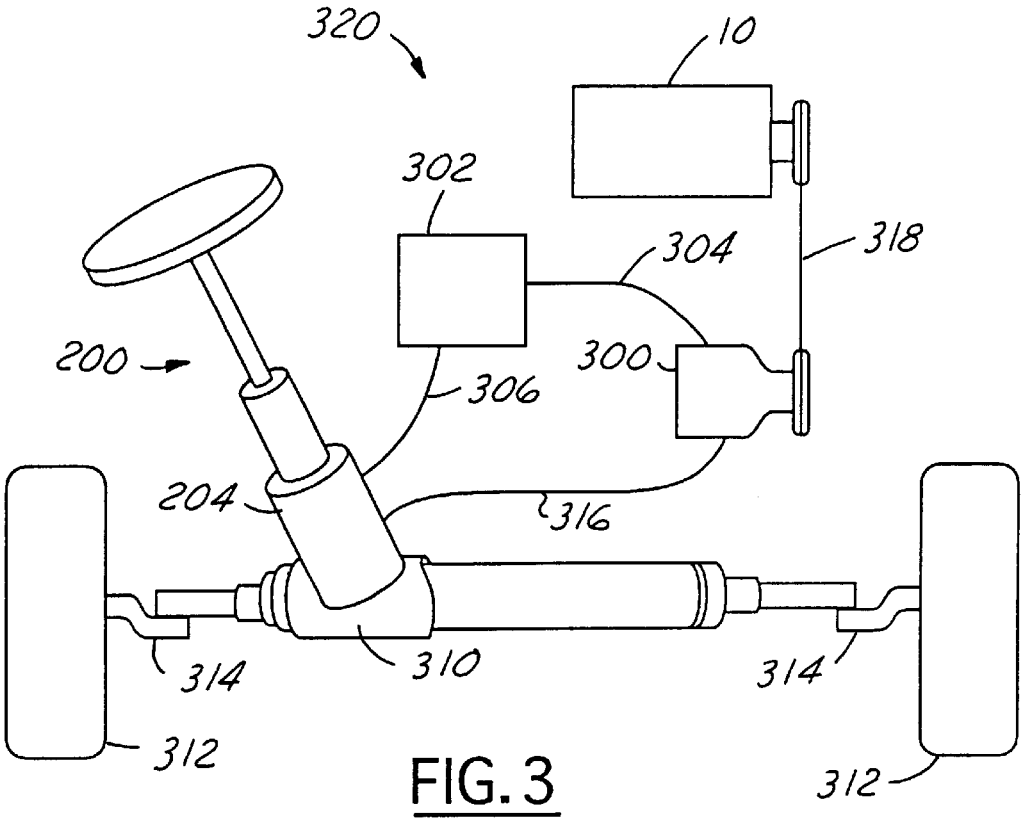
FIGS. 3 is an illustration showing an engine coupled a steering system and a hydraulic system.

Referring now to FIG. 3, steering system 200 is shown coupled to hydraulic system 320 and engine 10. Steering system 200 is shown connected to steering gear 310. Steering gear 310 is shown coupled to vehicle wheels 312 by steering linkage 314. Steering valve 204 interacts with power steering pump 300 by receiving pressurized fluid through pressure hose 316. Steering valve 204 returns fluid to reservoir 302 through return hose 306. Reservoir 302 is connected to power steering pump 300 by suction hose 304. Power steering pump receives power from engine 10 through belt 318.

Continuing with FIG. 3 to describe the interaction between steering system 200 and hydraulic system 320, the difference between steering wheel position TH_STW and housing position TH_HS creates assist torque TA by using pressurized fluid from power steering pump 300 to move steering gear 310, thus moving vehicle wheels 312 in the desired direction. As vehicle wheels 312 move, the difference between steering wheel position TH_STW and housing position TH_HS is decreased, lowering assist torque TA, until the difference between steering wheel position TH_STW and housing position TH_HS is zero. At this point, no assist torque TA is generated.

The interaction between steering system 200, hydraulic system 320, and engine 10 is now described with particular reference to FIG. 3. The torque transferred by belt 318 from engine 10 to power steering pump 300, power steering pump torque, PSPT, is related to the magnitude of assist torque, TA. In turn, the magnitude of assist torque, TA, is a function of the difference between steering wheel position, TH_STW, and housing position, TH_HS. The difference between steering wheel position, TH_STW, and housing position, TH_HS, is a function of the steering torque, STT, which is the torque applied by the driver on the steering wheel. Thus, a dynamic parametric model describing the interaction between steering system 200, hydraulic system 320, and engine 10 can be used with knowledge of the steering wheel position, TH_STW, to predict the power steering pump torque, PSPT, acting on engine 10.

An example of such a model for a steering system is known to those skilled in the art and described in SAE paper 960929, "Center-Closed Rotary Servo Valve for Power Steering," by Fukumura, Haga, Suzuki, and Mori. An example of a model for a hydraulic system is also known to those skilled in the art and described in SAE paper 960178, "Modeling, Characterization, and Simulation of the Automobile Power Steering Systems for the Prediction of On-Center Handling", by Post and Law. These are two of many models that can be used to estimate the pump torque using either a measurement of the steering wheel angle or the steering torque.

Figure 4:
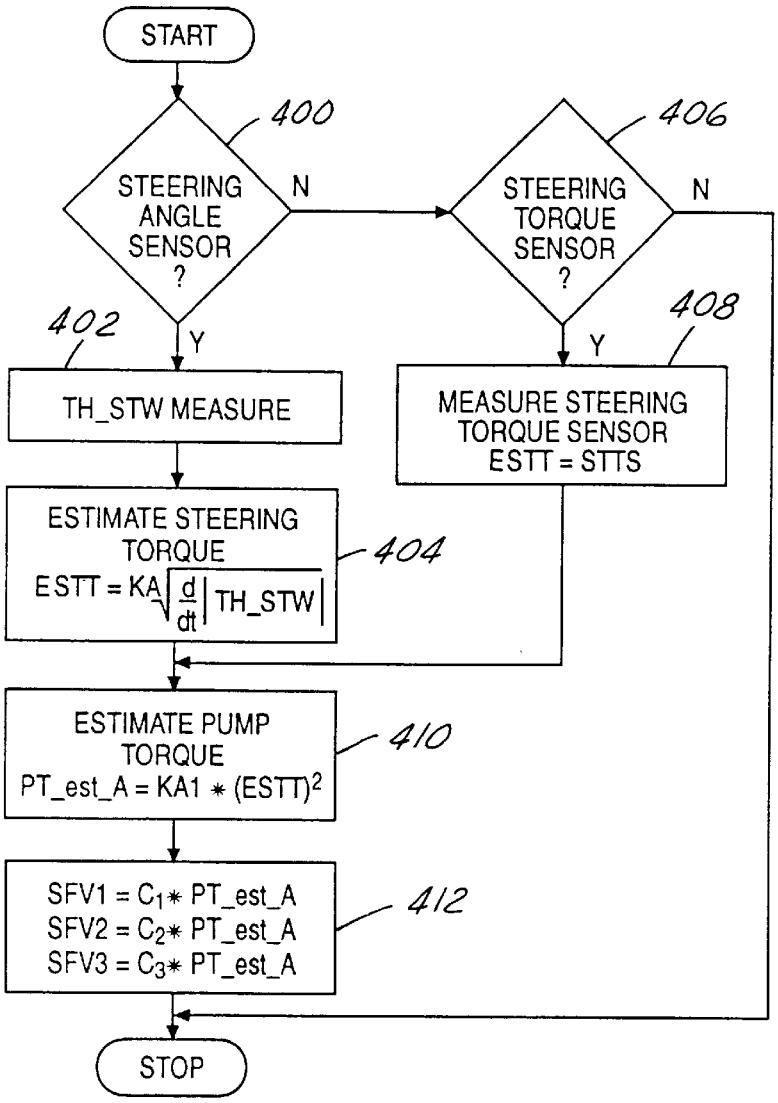
FIG. 4 is a high level flowchart of various operations performed by a portion of the embodiment shown in FIG. 1.

Referring now to FIG. 4, the routine executed by controller 12 for calculating an adjustment to engine operating conditions is now described. When a steering wheel sensor is present (step 400) controller 12 reads steering the wheel position sensor value, TH_STW, (step 402). During step 404, the steering wheel angle measurement is used to estimate the steering torque, ESTT, as a function of the steering wheel position, TH_STW (a constant, KA, multiplied by the square root of the derivative of the absolute value of steering wheel position, TH_STW). When no steering wheel sensor is present and a torque sensor is present (step 406), controller 12 reads steering wheel torque sensor value, STTS, and equates it directly to estimated steering torque, ESST, (step 408).

Continuing with FIG. 4, with the estimated steering torque, ESTT, controller 12 then estimates power steering pump torque requirement, PT_est_A, as a function of the estimated steering torque, ESTT (a constant, KA1, multiplied by the square of estimated steering torque, ESTT) (step 410). During step 412, feedforward adjustment values, SFV1, SFV2, and SFV3, are calculated by controller 12 by multiplying constants, C1, C2, or C3, by the power steering pump torque requirement, PT_est_A, respectively.

From the estimated power steering pump torque requirement, PT_est_A, controller 12 can predict a pump torque increase before it actually happens thus giving the engine control system time to adjust engine operating parameters to compensate for these effects. The additional time gained over the use of a pressure switch or transducer can be explained with reference to the power steering system describe above. When the driver turns the steering wheel, the steering valve is opened proportionally. This causes an increase in the pressure of one side of steering gear 310 and a decrease in the pressure of the other side of steering gear 310, thereby creating assist torque, TA. This also causes an overall power steering pump fluid pressure increase, measured by the pressure switch and transducer measure. Each of these processes take time, therefore, a prediction derived from the motion of the steering wheel can be obtained before a prediction derived from a pressure switch or transducer. Thus, because the engine control system contains inherent delays, the earlier estimate generated by the method of the present invention is much more effective at reducing engine speed fluctuations when the engine control system is attempting to maintain a constant engine speed.

The routine described in FIG. 4 may be limited to operate only in certain conditions, such as for example, in the idle condition. There are many methods known to those skilled in the art and suggested by this disclosure for determined when the vehicle is in the idle condition. For example, the idle condition may be defined as when the vehicle speed is below a predetermined vehicle speed.

Figure 5:
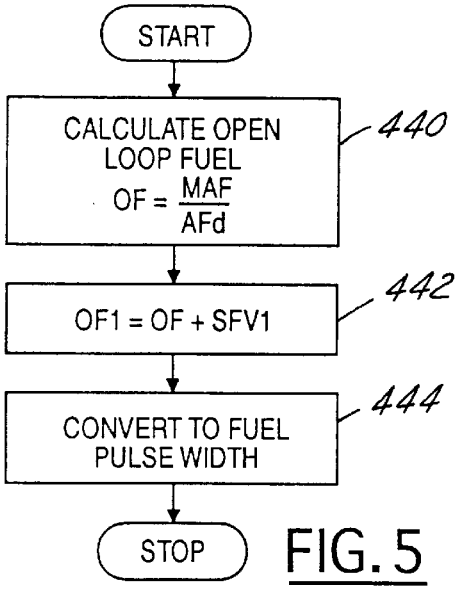
FIG. 5 is a high level flowchart of various operations performed by a portion of the embodiment shown in FIG. 1.

The routine executed by controller 12 to generate the desired quantity of liquid fuel delivered to engine 10 for maintaining a desired engine speed is now described with reference to FIG. 5. During step 440, an open-loop fuel quantity is first determined by dividing a measurement of inducted mass airflow, MAF, by a desired air/fuel ratio, AFd, which is typically the stoichiometric value for gasoline combustion. This open-loop fuel quantity is then adjusted by value, SFV1, (step 442) as described earlier herein. During step 444, the adjusted open-loop fuel quantity is converted to fuel pulse width signal, FPW.

Figure 6:
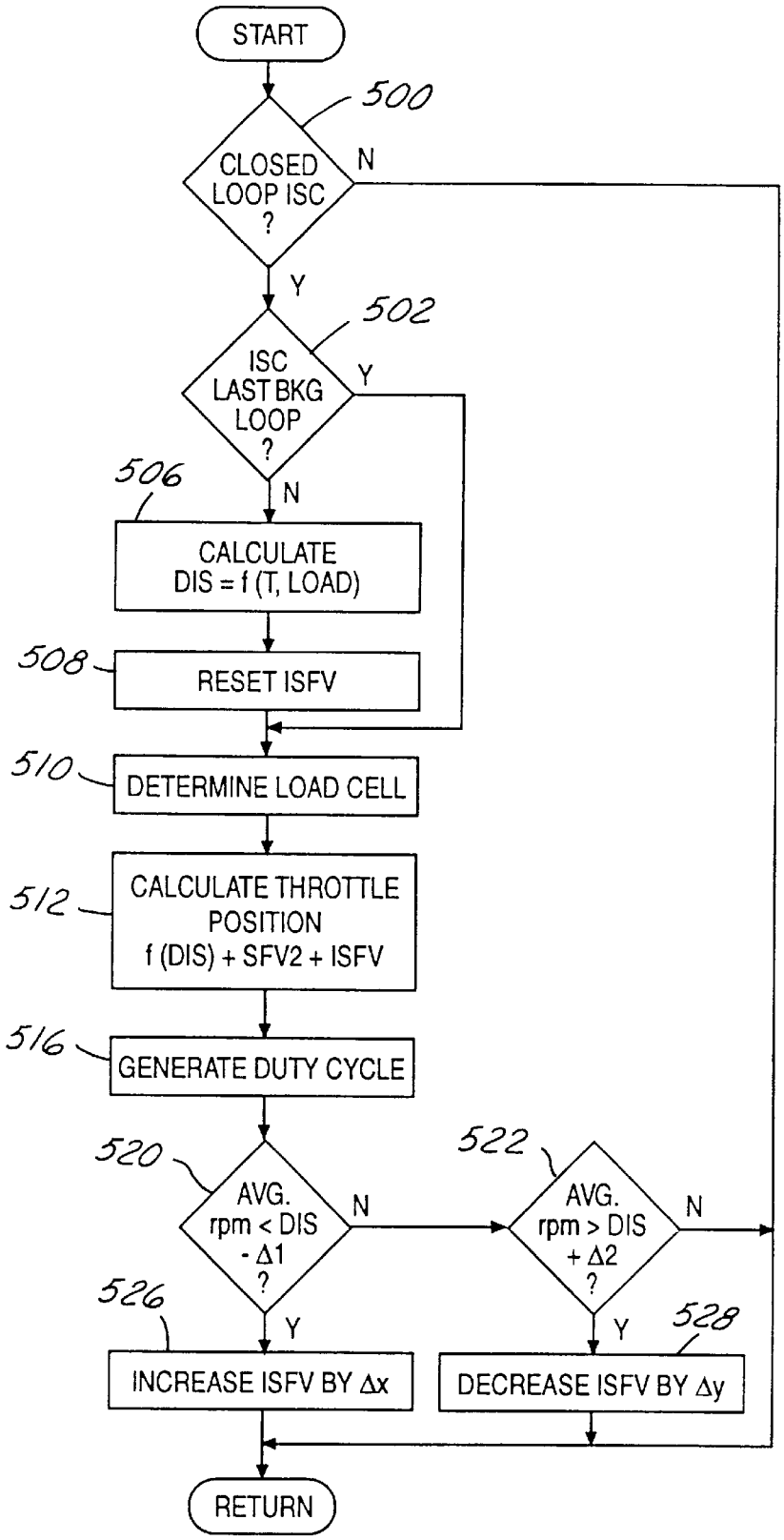
FIG. 6 is a high level flowchart of various operations performed by a portion of the embodiment shown in FIG. 1.

Referring now to FIG. 6, the idle speed feedback control routine performed by controller 12 is now described. Feedback or closed loop idle speed control, ISC, commences when preselected operating conditions are detected (see step 500). Typically such operating conditions are at a closed primary throttle position and an engine speed less than a preselected value, thereby distinguishing closed throttle idle from closed throttle deceleration.

Closed loop idle speed control continues for the time period during which selected engine operating conditions remain at preselected values. At the beginning of each idle speed control period (see step 502), a desired (or reference) idle speed, DIS, is calculated as a function of engine operating conditions such as engine speed, RPM, and coolant temperature (see step 506). The previous idle speed feedback variable, ISFV, is also reset to zero (see step 508) at the beginning of each idle speed control period.

After the above described initial conditions are established, the following steps (510–528) are performed at each background loop of controller 12. During step 510, the appropriate load operating cell, which is indicated by the current value of the manifold absolute pressure, MAP, is selected to receive idle speed correction. Controller 12 then calculates the desired throttle position for bypass throttling device 66 (step 512). The desired idling speed DIS at the beginning of the idle speed control period is converted into a bypass throttle position, typically by a look-up table.

Continuing with step 512 shown in FIG. 6, the bypass throttle position is corrected by the idle speed feedback variable ISFV, the generation of which is described below. The bypass throttle position corrected by the idle speed feedback variable is further adjusted by the feedforward variable SFV2. The idle speed duty cycle ISDC for operating solenoid valve 72 of bypass throttling device 66 is then calculated in step 516. This duty cycle moves the bypass throttle to the value calculated in step 512.

Controller 12, in this one example of operation, provides a dead band with hysteresis around desired idle speed, DIS, in steps 520 and 522. When average engine speed is less than the dead band (DIS minus W1), idle speed feedback variable, ISFV, is increased by predetermined amount, Wx, in step 526. When average engine speed is greater than the dead band (DIS plus W2), ISFV is decreased by predetermined amount, Wy, in step 528. Accordingly, ISFV, will appropriately increase or decrease the bypass throttle position (see step 512) to maintain, on average, desired idle speed, DIS.

Figure 7:
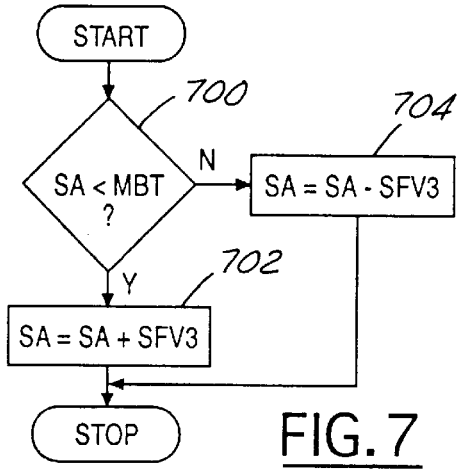
FIG. 7 is a high level flowchart of various operations performed by a portion of the embodiment shown in FIG. 1.

The routine executed by controller 12 to generate the desired ignition timing delivered to engine 10 is now described with reference to FIG. 7. When the ignition timing signal, SA, is less than an optimum ignition timing, MBT (step 700), ignition timing signal, SA, is increased (step 702). When the ignition timing signal, SA, is greater than an optimum ignition timing, MBT, (step 700), ignition timing signal, SA, is decreased (step 704). Optimum ignition timing, MBT, is defined as the amount of ignition timing for given engine operating conditions that produces the maximum torque.

The present invention measures steering torque, or estimates steering torque from steering wheel position, to obtain an estimate of the power steering pump torque, PSPT, imposed on the engine. From this estimate, engine control system 12 can adjust engine control parameters, such as air flow, air/fuel ratio, and ignition timing, before the power steering pump torque, PSPT, is imposed on the engine. The ability to adjust engine parameters before the onset of the disturbance allows for the reduction in engine speed fluctuations.

Many variations and modifications of the present invention are possible without departing from the spirit and scope of the invention. For example, many different types of position sensors and torque sensors are available for measuring the steering wheel position. Also, many different levels of detail can be included in the steering system model, leading to alternate control schemes where an estimate of the power steering pump torque, PSPT, is obtained from either a steering wheel position measurement or a steering torque measurement. Accordingly, the following claims including all equivalents, define the present invention.

We claim:

1. An idle speed control adjustment method for an internal combustion engine of a vehicle provided with a power steering system accessory powered by the engine, the method comprising the steps of:

generating a power steering pump torque requirement estimate in response to a steering torque measurement; and adjusting an engine control signal in response to the power steering pump torque requirement estimate.

2. The method recited in claim 1 wherein said steering torque measurement is created from a steering wheel position sensor.

3. The method recited in claim 1 wherein said steering torque measurement is created from a steering wheel torque sensor.

4. The method recited in claim 1 wherein said adjusting step further comprises the step of adjusting a fuel pulse width of said engine.

5. The method recited in claim 1 wherein said adjusting step further comprises the step of adjusting an idle air bypass valve of said engine.

6. The method recited in claim 1 wherein said adjusting step further comprises the step of adjusting an ignition timing of said engine.

7. The method recited in claim 1 where said creating step further comprises the step of modifying the power steering torque requirement estimate in response to a vehicle speed signal.

8. A method for preventing changes in engine speed of an automotive vehicle under predetermined steering conditions, the vehicle including a power steering pump, a steering gear, and a steering wheel connected to the steering gear by a linkage, the method comprising the steps of:

measuring engine speed of said vehicle;

measuring vehicle speed of said vehicle;

measuring a steering wheel deviation of said steering wheel from a known position;

determining an estimated amount of torque required by the steering pump in response to engine speed, vehicle speed, and steering wheel deviation; and adjusting an engine control signal in response to the estimated amount of torque.

9. The method recited in claim 8 wherein said adjusting step further comprises the step of adjusting a fuel pulse width of said engine.

10. The method recited in claim 8 wherein said adjusting step further comprises the step of adjusting an air control valve of said engine.

11. The method recited in claim 8 wherein said adjusting step further comprises the step of adjusting an ignition timing of said engine.

12. The method recited in claim 8 wherein said adjusting step further comprises the steps of adjusting a fuel pulse width of said engine, adjusting an air control valve of said engine, and adjusting an ignition timing of said engine.

13. A control system for controlling engine idle speed in a vehicle including a power steering pump, a steering gear, and a steering wheel connected to the steering gear by a linkage, the system comprising;

a steering wheel position sensor;

an engine speed sensor;

a vehicle speed sensor; and a controller for creating an estimated power steering pump torque requirement in response to said steering wheel position sensor and for adjusting an engine control signal in response to the estimated power steering pump torque requirement, engine speed sensor, and vehicle speed sensor.

14. The system recited in claim 13 wherein said controller further adjusts a fuel pulse width of said engine in response to the estimated power steering pump torque requirement.

15. The system recited in claim 13 wherein said controller further adjusts an air control valve of said engine in response to the estimated power steering pump torque requirement.

16. The system recited in claim 13 wherein said controller further adjusts a ignition timing of said engine in response to the estimated power steering pump torque requirement.

* * * * *